US006923465B2

(12) United States Patent
DuBuque

(10) Patent No.: US 6,923,465 B2
(45) Date of Patent: Aug. 2, 2005

(54) HEEL SHIM AND LIFTER FOR SKI MOUNTAINEERING

(76) Inventor: Armond DuBuque, 32901 138th St. Southeast, Sultan, WA (US) 98294

( * ) Notice: Subject to any disclaimer, the term of this patent is extended or adjusted under 35 U.S.C. 154(b) by 0 days.

(21) Appl. No.: 10/261,511

(22) Filed: Sep. 30, 2002

(65) Prior Publication Data

US 2003/0137129 A1 Jul. 24, 2003

Related U.S. Application Data

(60) Provisional application No. 60/326,317, filed on Sep. 30, 2001.

(51) Int. Cl.[7] ..... A63C 9/00; A63C 5/00; A63C 9/081; A63C 9/10; A43B 5/04

(52) U.S. Cl. ..... 280/636; 280/607; 280/614; 280/618; 280/632; 36/117.4

(58) Field of Search ..... 280/611, 613, 280/614, 615, 616, 617, 619, 620, 621, 623, 636, 618, 626, 631, 632, 633, 634, 635; 36/115, 117.1, 117.2, 117.3, 117.4

(56) References Cited

U.S. PATENT DOCUMENTS 4,002,354 A * 1/1977 Ramer ..... 280/614
4,113,275 A * 9/1978 Sherwin ..... 280/615
4,273,354 A * 6/1981 George ..... 280/614
4,403,789 A * 9/1983 Hickey ..... 280/614
5,318,320 A * 6/1994 Ramer ..... 280/614
5,560,633 A * 10/1996 McGowan ..... 280/614
6,431,578 B2 * 8/2002 Pedersen et al. ..... 280/626

OTHER PUBLICATIONS

Hammerhead telemark binding (side view). Product of Rainey Designs, www.raineydesigns.com. Image downloaded from the World Wide Web on Sep. 30, 2002, from http://www.raineydesigns.com/images/hh1.JPG.
Hammerhead telemark binding (diagonal view). Product of Rainey Designs, www.raineydesigns.com. Image downloaded from the World Wide Web on Sep. 30, 2002, from http://www.raineydesigns.com/images/hh2.JPG.

(Continued)

*Primary Examiner*—Christopher P. Ellis
*Assistant Examiner*—Gerald B Klebe
(74) *Attorney, Agent, or Firm*—Thomas E. Loop

(57) ABSTRACT

The present invention discloses a heel shim and lifter assembly adapted for use in ski mountaineering. In one embodiment, the heel shim and lifter assembly is adapted for use with a ski such as, for example, a telemark ski, and comprises: a mounting plate for attaching the heel shim and lifter assembly onto the ski; and a heel shim block or component that is pivotably connected to the mounting plate. In this embodiment, the heel shim block or component is pivotably connected to the mounting plate along an axis of rotation that runs perpendicular to the longitudinal axis of the ski and parallel to the top surface of the ski when the heel shim and lifter assembly is attached onto the ski, and wherein the heel shim block is pivotable between a heel shim skiing position and an elevated hiking position when the heel shim and lifter assembly is attached onto the ski.

1 Claim, 3 Drawing Sheets

OTHER PUBLICATIONS

Riva Z backcountry telemark binding. Product of Black Diamond Equipment, Salt Lake City, Utah, USA. Image downloaded from the World Wide Web on Sep. 30, 2002, from http://www.blackdiamondequipment.com/images/big/big_bindings_riva_z.jpg.

Riva Z backcountry telemark binding with kit. Product of Black Diamond Equipment, Salt Lake City, Utah, USA. Image downloaded from the World Wide Web on Sep. 30, 2002, from http://www.blackdiamondequipment.com/images/big/big_rivaz.jpg.

Diamir Titanal III alpine touring ski binding. Product of Fritchi AG of Switerland. Image available on the World Wide Web on Sep. 30, 2002, at http://www.thinkmountain.com/images/store/large/Diamir_Titanal_3_RGB.jpg.

CXP telemark boot. Product of Crispi Sport srl, Maser, Italy. Image downloaded from the World Wide Web on Sep. 30, 2002, from http://www.crispi.it/prodotti/cxp_z.jpg.

Tele–Vates, Ski Leash and Ski Strap skiing accessories. Products of Black Diamond Equipment, Salt Lake City, Utah, USA. Image downloaded from the World Wide Web on Sep. 30, 2002, from http://www.blackdiamondequipment.com/images/big/big_bindingaccess.jpg.

* cited by examiner

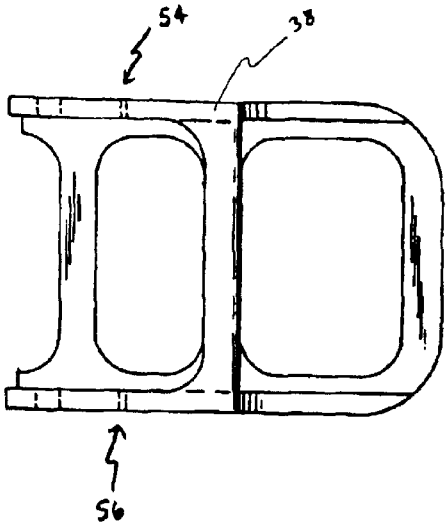
FIG. 2C
FIG. 3A
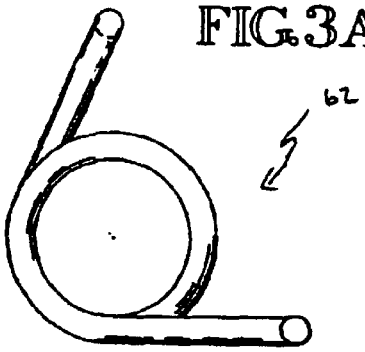
FIG. 4A
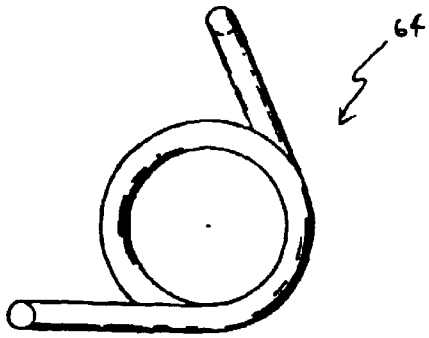
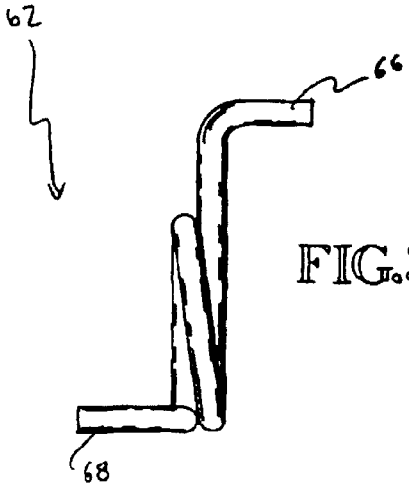
FIG. 3B
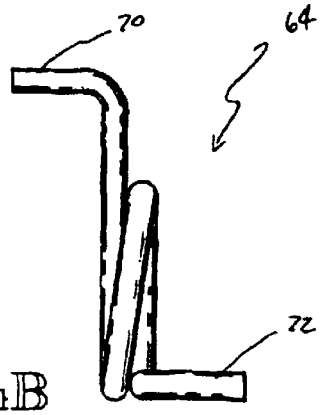
FIG. 4B FIG. 5A
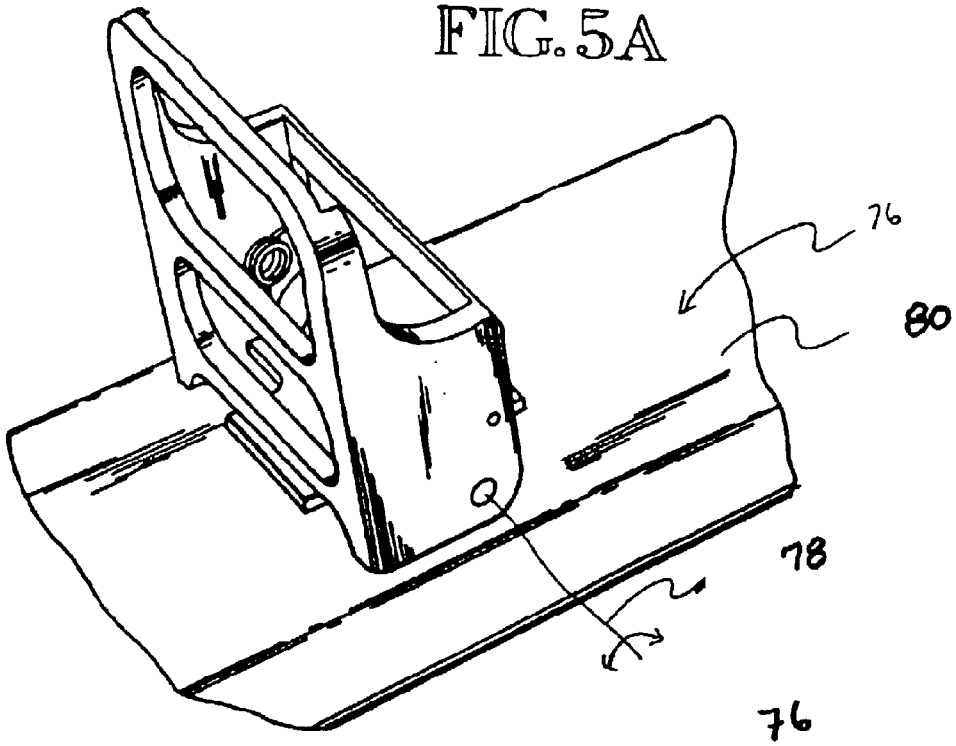
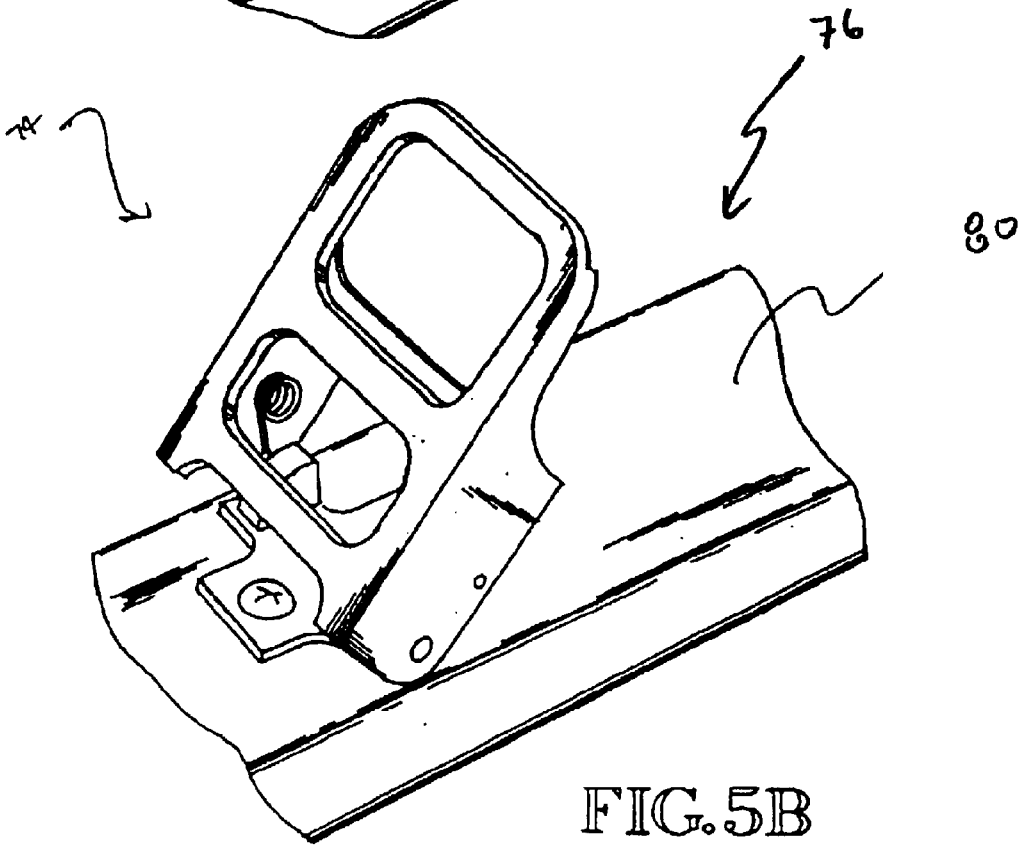
FIG. 5B

HEEL SHIM AND LIFTER FOR SKI MOUNTAINEERING

CROSS-REFERENCE TO RELATED APPLICATION

This application claims the benefit of U.S. Provisional Application No. 60/326,317 filed Sep. 30, 2001, which provisional application is incorporated herein by reference in its entirety.

TECHNICAL FIELD

The present invention is directed to a heel shim and lifter that facilitates ski mountaineering and, more particularly, to a heel shim and lifter that, when mounted on a ski, is pivotable between a heel shim skiing position and an elevated hiking position.

BACKGROUND OF THE INVENTION

Telemark skiing is believed to have originated in the Nordic region of Europe many thousands of years ago as a better way of traveling over snow covered terrain. Traditionally, telemark skiing is done with leather boots attached to a binding system that allows one's heel to be free or detached from the underlying ski (hence, telemark skiing is also referred to as "free-heel skiing"). This style of skiing is characterized by the telemark style of turn (as opposed to the parallel style of turn which is made with secured-heel binding systems). In a typical telemark turn the downhill ski leads while the skier's legs scissor apart. Thus, and because the skier's boots are only attached to the skis by their toes, a telemark skier can cross country ski on level and slightly inclined terrain, traverse up steeper terrain (usually aided with the use of "skins" affixed to the bottom of one's skis), and use the telemark style of turn to control speed and direction upon the descent. The various modes of travel of telemark or free-heel skiing are, at times, collectively referred to herein as ski mountaineering.

Telemark skiing has gained significant popularity in recent years; as such, many advancements in telemark skiing technology have recently been made. For example, boots are now also commonly made of an all plastic construction and binding systems are becoming much more complex. In addition, more and more binding systems are using "shims" to further elevate the skier's boots away from the tops of the skier's skis. A typical shim consists essentially of flat plastic plate that lies directly beneath the binding and ranges in thicknesses from about 7 mm up to 30 mm (for racers). It is believed that the use of shims enhances the skier's ability to edge, and at the same time prevents the skier from "booting out" on steep slopes or hard pack (booting out refers to when the skier's boot hits the slope causing the boot to lever the ski edge off the snow, thereby causing loss of control of the ski). One disadvantage associated with existing state-of-the-art heel shims, however, is that they are prone to snow build-up.

In addition to the use of shims, telemark skiers are now also using a variety of heel "lifters" to facilitate hiking uphill (i.e., traversing up steeper terrain—usually aided with the use of "skins" affixed to the bottom of one's skis). A heel lifter is simply a device that provides additional elevation between the heel part of the boot and the ski. One common type of heel lifter consists essentially of a short plastic tube that conveniently straps onto the heel portion of the boot (wherein the height of the plastic tube determines the amount of additional lift or heel elevation). Another common type of heel lifter consists essentially of a U-shaped rigid wire or rod that can be flipped up from a fixed shim block—the flipped up wire or rod serves as the heel lifter. Disadvantages associated with this type of heel lifter includes its overall flimsiness, as well as its tendency to flip down to the skiing position.

Accordingly, there is a need in the art for new and improved heel shims and lifters that facilitates ski mountaineering, as well as to methods relating to the same. The present invention fulfills these needs and provides for further related advantages.

SUMMARY OF THE INVENTION

In brief, the present invention is directed to a heel shim and lifter assembly adapted for use in ski mountaineering. In one embodiment, the heel shim and lifter assembly is adapted for use with a ski such as, for example, a telemark ski, and comprises: a mounting plate for attaching the heel shim and lifter assembly onto the ski; and a heel shim block pivotably connected to the mounting plate. In this embodiment, the heel shim block is pivotably connected to the mounting plate along an axis of rotation that runs perpendicular to the longitudinal axis of the ski and parallel to the top surface of the ski when the heel shim and lifter assembly is attached onto the ski, and wherein the heel shim block is pivotable between a heel shim skiing position and an elevated hiking position when the heel shim and lifter assembly is attached onto the ski.

These and other aspects of the present invention will be evident to those skilled in the art upon reference to the following detailed description and related drawings.

BRIEF DESCRIPTION OF THE DRAWINGS

FIG. 2C illustrates a bottom plan view of the heel shim block shown in FIGS. 2A and 2B.

FIG. 3A illustrates a side elevational view of right-hand wound coil spring in accordance with an embodiment of the present invention.

FIG. 3B illustrates a front elevational view of the coil spring shown in FIG. 3A.

FIG. 4A illustrates a side elevational view of left-hand wound coil spring in accordance with an embodiment of the present invention.

FIG. 4B illustrates a front elevational view of the coil spring shown in FIG. 4A.

FIG. 5A illustrates a top perspective view of a heel shim and lifter in accordance with an embodiment of the present invention, wherein the heel shim block is shown in its elevated hiking position.

FIG. 5B illustrates a top perspective view of a heel shim and lifter in accordance with an embodiment of the present invention, wherein the heel shim block is shown in an intermediate position that is in between its elevated hiking position and its heel shim skiing position.

DETAILED DESCRIPTION OF THE INVENTION

As noted above, the present invention is directed to a heel shim and lifter that facilitates ski mountaineering and, more particularly, to a heel shim and lifter that, when mounted on a ski, is pivotable between a heel shim skiing position and an elevated hiking position. The heel shim and lifters disclosed herein provides for several advantages over many of the existing devices including (1) superior strength and durability, (2) less snow build-up, and (3) ease of positioning between a heel shim skiing position and an elevated hiking position. Although many specific details of certain embodiments of the present invention are set forth in the following detailed description and related drawings, those skilled in the art will recognize that the present invention may be practiced without several of the details or advantages disclosed herein.

Thus, and with reference to the accompanying drawings, the heel shim and lifter assembly in accordance with the present invention is adapted for use with a ski. In one embodiment, the heel shim and lifter assembly comprises a mounting plate for attaching the heel shim and lifter assembly onto the ski, and a heel shim block pivotably connected to the mounting plate. More specifically, the heel shim block is pivotably connected to the mounting plate along an axis of rotation that runs perpendicular to the longitudinal axis of the ski and parallel to the top surface of the ski when the heel shim and lifter assembly is attached onto the ski. Moreover, and in this configuration and when the heel shim and lifter assembly is attached onto the ski, the heel shim block is pivotable between a heel shim skiing position and an elevated hiking position.

In one preferred embodiment, the heel shim and lifter assembly further comprises a spring mechanism that applies (i) a force tangential and counter clockwise to the axis of rotation when the heel shim block is at the elevated hiking position, and (ii) a force tangential and clockwise to the axis of rotation when the heel shim block is at the heel shim skiing position. (Note, the appropriate frame of reference for the direction of rotation of the heel shim lifter is having the ski tip is on the left hand side of the reference frame.)

Figure 1A:
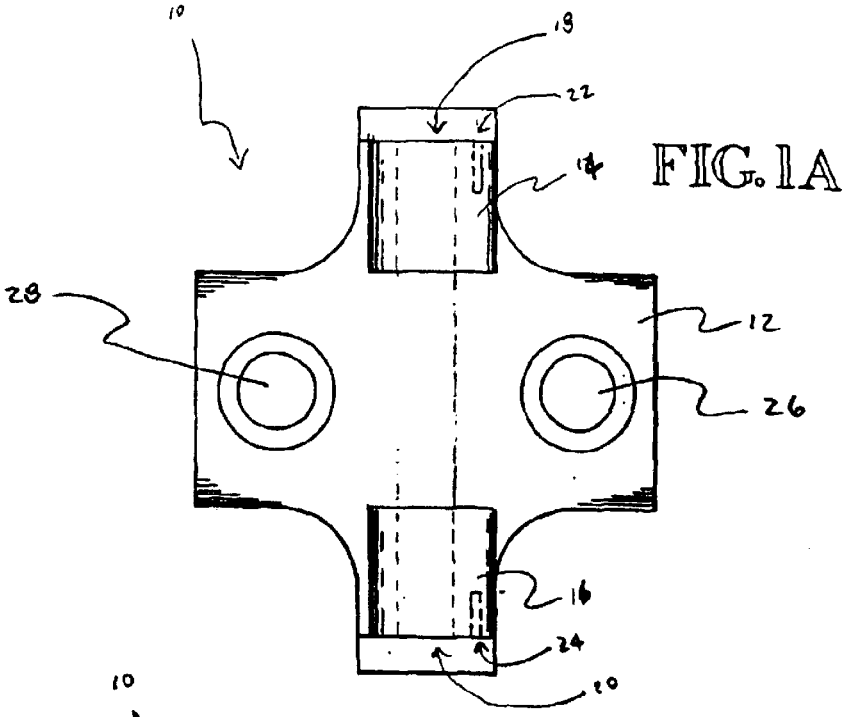
FIG. 1A illustrates a top plan view of a mounting plate in accordance with an embodiment of the present invention.
Figure 1B:
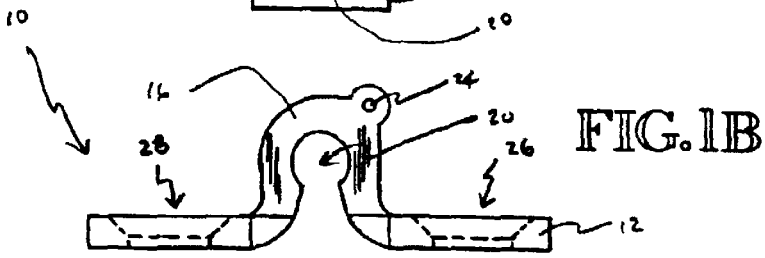
FIG. 1B illustrates a side elevational view of the mounting plate shown in FIG. 1A.

In view of the foregoing, FIGS. 1A and 1B illustrate an exemplary mounting plate 10 (for attaching a heel shim and lifter assembly onto a ski) in accordance with the present invention. As shown, the mounting plate 10 comprises a flat metal plate 12 that supports opposing first and second trunnions 14, 16. Each of the opposing first and second trunnions 14, 16 include primary first and second central holes 18, 20 adapted to fit a pivot rod (not shown) there-between, and secondary first and second peripheral holes 22, 24 adapted to fit a protruding leg of a coil spring (not shown). The mounting plate 10 also comprises first and second mounting holes 26, 28 for attaching via screws (not shown) the mounting plate 10 onto a ski. The mounting plate 10 is preferably made (i.e., machined from an extrusion) out of a light weight metal such as, for example, aluminum; however, other metals and materials that are of sufficient strength and durability are within the scope of the present invention.

Figure 2A:
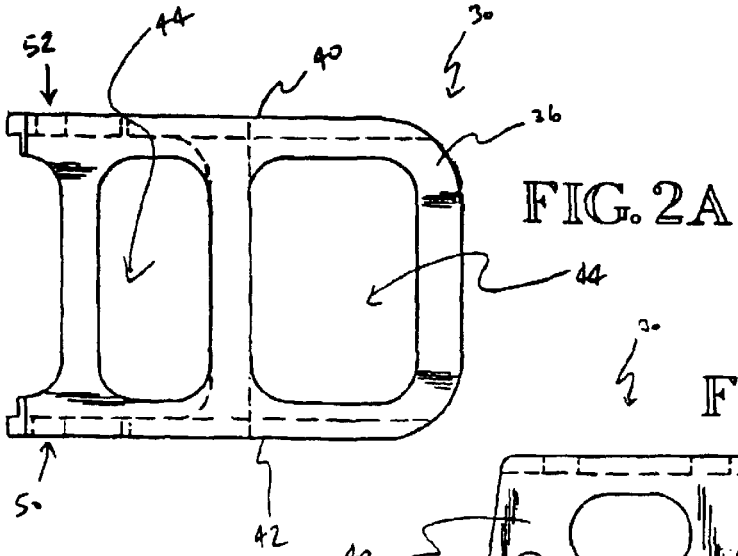
FIG. 2A illustrates a top plan view of a heel shim block in accordance with an embodiment of the present invention.
Figure 2B:
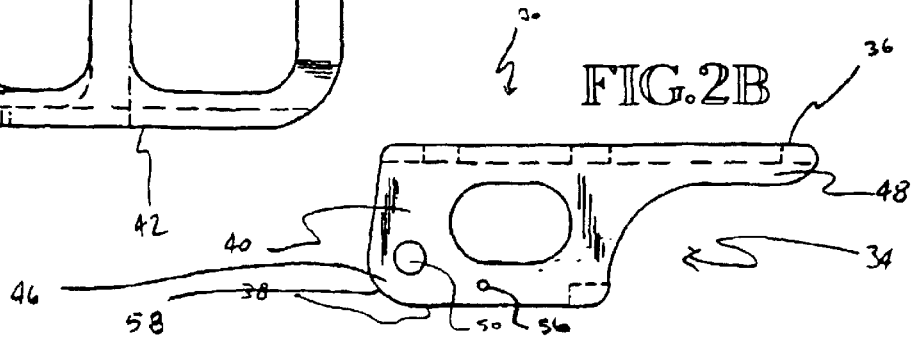
FIG. 2B illustrates a side elevational view of the heel shim block shown in FIG. 2A.

FIGS. 2A, 2B and 2C illustrate an exemplary heel shim block 30 (which block or component pivotably connects to the above-described mounting plate) in accordance with the present invention. As shown, the heel shim block 30 comprises a metal block having a central cavity 34 (i.e., a hollowed out region) that is bounded by a top surface 36, a bottom surface 38, and opposing side surfaces 40, 42. The top surface 36 may have one or more holes 44 that extend onto the central cavity 34, wherein the one or more holes 44 help prevent snow build-up on the top surface 36. The metal block also comprises a front lower pivot connection portion 46 and a rear upper tail portion 48. The front lower pivot connection portion 46 includes opposing first and second pivot rod connection holes 50, 52 that extend through the opposing side surfaces 40, 42, respectively, as well as opposing first and second coil spring leg connection holes 54, 56 that also extend through the opposing side surfaces 40, 42, respectively. The opposing first and second pivot rod connection holes 50, 52 are adapted to fit a pivot rod (not shown) there-between, whereas the opposing first and second coil spring leg connection holes 54, 56 are each adapted to fit a protruding leg of a coil spring (not shown). As is further shown, the opposing side surfaces 40, 42 of the metal block have rounded edges 58, 60 on the front lower pivot connection portion 46. The heel shim block 30 is preferably made (i.e., machined from an tubular extrusion) out of a light weight metal such as, for example, aluminum; however, other metals and materials that are of sufficient strength and durability are within the scope of the present invention.

FIGS. 3A and 3B illustrate an exemplary right-hand wound coil spring 62 and FIGS. 4A and 4B illustrate an exemplary left-hand wound coil spring 64 (which coil springs provide tension that holds the heel shim block 30 in either a heel shim skiing position or an elevated hiking position) in accordance with the present invention. As shown, each wound coil spring comprises protruding legs 66, 68, 70, 72, each of which are adapted to fit into the secondary first and second peripheral holes 22, 24 associated with the opposing first and second trunnions 14, 16 of the mounting plate 10 and/or the opposing first and second coil spring leg connection holes 54, 56 associated with the front lower pivot connection portion 46 of the heel shim block 30. The coil springs are preferably made out of a stainless steel wire; however, other metals and materials that are of sufficient strength and durability are within the scope of the present invention.

FIG. 5A illustrates the complete assembly, namely, a heel shim and lifter assembly 74 mounted onto a ski 76 (wherein the heel shim block 30 is positioned in its elevated hiking position). FIG. 5B illustrates the heel shim and lifter assembly 74 mounted onto the ski 76 (wherein the heel shim block is shown in an intermediate position that is in between its elevated hiking position and its heel shim skiing position). As shown, the heel shim block 30 is pivotably connected by means of a pivot rod (not shown) to the mounting plate 10 along an axis of rotation 78 that runs perpendicular to the longitudinal axis of the ski 76 and parallel to the top surface 80 of the ski 76 (when the heel shim and lifter assembly 74 is attached onto the ski 76). Moreover, and in this configuration, the spring mechanism (e.g., the above-described coil springs) of the heel shim and lifter assembly 74 applies (i) a force tangential and counter clockwise to the axis of rotation 78 when the heel shim block 30 is at the elevated hiking position, and (ii) a force tangential and clockwise to the axis of rotation 78 when the heel shim block 30 is at the heel shim skiing position. In other words, the heel shim block 30 is held firmly in either of its two position by virtue of the spring mechanism.

Although the heel shim and lifter assembly of the present invention has been described in the context of the embodiments illustrated and disclosed herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalents are to be embraced within their scope.

What is claimed is:

1. A heel shim and lifter assembly adapted for use with a ski, comprising:

a mounting plate;

a heel shim pivotably connected to the mounting plate along an axis of rotation that runs perpendicular to the longitudinal axis of the ski and parallel to the top surface of the ski, wherein the heel shim is pivotable between a heel shim skiing position and an elevated hiking position; and at least one coil spring connected to the mounting plate and the heel shim, wherein the at least one coil spring has a center axis that is substantially parallel to the axis of rotation of the heel shim, and wherein the at least one coil spring applies (i) a force tangential and counter clockwise to the axis of rotation when the heel shim is at the elevated position, and (ii) a force tangential and clockwise to the axis of rotation when the heel shim is at the heel shim skiing position.

* * * * *